United States Patent [19]

Hesler

[11] 4,104,619

[45] Aug. 1, 1978

[54] SMOKE DETECTOR

[75] Inventor: Joseph P. Hesler, Liverpool, N.Y.

[73] Assignee: General Electric Company, Syracuse, N.Y.

[21] Appl. No.: 728,524

[22] Filed: Oct. 1, 1976

[51] Int. Cl.[2] ..... G08B 17/10

[52] U.S. Cl. ..... 340/629; 250/381; 331/65; 331/108 D; 331/111

[58] Field of Search ..... 340/237 S; 331/108 D, 331/113 R, 111, 65; 250/381

[56] References Cited

U.S. PATENT DOCUMENTS

| | | | |
|---|---|---|---|
| 3,516,083 | 6/1970 | Meyer | 340/237 S |
| 3,875,527 | 4/1975 | Garcia | 331/108 D X |

FOREIGN PATENT DOCUMENTS

| | | | |
|---|---|---|---|
| 2,453,062 | 5/1975 | Fed. Rep. of Germany | 340/237.5 |

OTHER PUBLICATIONS

RCA Publication: Digital Integrated Circuits; Astable & Monostable Oscillators Using RCA COS/MOS D.I.C.'s by Dean et al., Mar. 1971, pp. 353–355.

*Primary Examiner*—John W. Caldwell, Sr.
*Assistant Examiner*—Daniel Myer
*Attorney, Agent, or Firm*—Richard V. Lang; Carl W. Baker; Frank L. Neuhauser

[57] ABSTRACT

A smoke detector comprising a smoke detection cell of the ionization type and an electrical network providing for a.c. operation of the detection cell. The impedance of the detection cell changes in the presence of airborne combustion products and alters the operating frequency of the network. The frequency change is sensed to actuate an alarm. A.C. operation avoids the problem of d.c. instability in the high impedance detection cell circuit and simplifies sensing the electrical condition of the detection cell. The electrical network typically uses MOS-FET devices as the active circuit elements.

11 Claims, 8 Drawing Figures

SMOKE DETECTOR

BACKGROUND OF THE INVENTION

1. Field of the Invention

The present invention relates to smoke detectors employing detection cells of the ionization type, and to the associated electrical circuitry for operation of the detection cell and for sensing the electrical changes which occur in the presence of airborne combustion products.

2. Description of the Prior Art

A smoke detection cell of the ionization type and circuits for d.c. operation of the detection cell are described in patent applications of Robert J. Salem, Ser. No. 630,204, filed Nov. 10, 1975, entitled "Smoke Simulating Test Apparatus for Smoke Detectors" and Ser. No. 630,202, filed Nov. 10, 1975, entitled "High Gain Sensing and Switching Means for Smoke Detectors", and assigned to the assignee of the present application.

A smoke detection cell of the ionization type suitable for use in the present application is described in said applications. It includes an alpha radiation source, such as a small quantity of Americium 241, in a measuring chamber having positive and negative electrodes. The measuring chamber ionizes the air between the electrodes, permitting the flow of a small electrical current when a d.c. voltage is applied across the electrodes. When airborne products of combustion (smoke) enter the measuring chamber, an increase in resistance to the flow of current is observed. The resulting change in the electrical conductivity of the measuring chamber is sensed and used to trigger an alarm when the change exceeds a given quantity. The latter quantity is selected to correspond to a level of smoke or aerosols within the measuring chamber representing a dangerous condition.

Electrical conductivity of the measuring chamber is sensed in said patent applications by measurement of the voltage across the measuring chamber, with the chamber being connected into a d.c. half-bridge. The other element of the half-bridge may be a resistance having a value comparable to that of the chamber or a second chamber from which airborne combustion products are excluded.

SUMMARY OF THE INVENTION

It is an object of the present invention to provide an improved smoke detector employing an ionization type detection cell.

It is another object of the present invention to provide an improved smoke detector in which the problems of d.c. drift and static charge accumulation are avoided, while maintaining a high sensitivity.

These and other objects of the present invention are achieved in a novel smoke detector comprising a smoke detection cell connected into an electrical network providing a.c. energization to the detection cell. The detection cell includes a measuring chamber open to the ambient air and any airborne products of combustion; a source of radiation disposed within the chamber for ionizing the contained air and airborne matter; and a pair of spaced conductive electrodes disposed within the chamber for establishing an electric field which attracts positively ionized particles to one electrode and negatively ionized particles to the other electrode. In operation, ions impinging on the electrodes produce a small current whose direction depends on field polarity. When airborne products of combustion are present in the air, the current in the detection cell decreases and its resistance increases.

The electrical network, of which a parameter dependent on the resistance of the detection cell is sensed to detect combustion products, comprises an alternating voltage source, means for applying the alternating voltage to the detection cell; and sensing means responsive to the selected parameter. An alarm is actuated when a predetermined change in the selected network parameter is sensed.

In one form of the invention, the frequency of the source is the network parameter which varies as a function of the resistance of the detection cell and the sensing means is a frequency discriminator.

In a practical form of the invention, the a.c. source includes a first and a second phase inverting amplifier connected in cascade and having a regenerative feedback path comprising a capacitor coupled between the output of the second amplifier and the input of the first amplifier. One electrode of the detection cell is coupled to the input of the first inverting amplifier, and the other electrode of the detection cell is coupled to the output of the first inverting amplifier. By this connection, the detection cell provides a current path for charging and for discharging the capacitor, thereby affecting the rate of charge and discharge of the capacitor and thereby the period or frequency of the network oscillation.

The a.c. output is preferably a square wave. The first and second phase inverting amplifier may have a single threshold. Typically, the first and second inverting amplifiers employ C-MOS FET devices, each amplifier comprising a P channel FET and an N channel FET.

Alternatively, the a.c. source may take the form of a Schmitt trigger having a regenerative feedback path comprising the detection cell coupled between the amplifier output and amplifier input and a capacitor coupled between the amplifier input and ground. The detection cell provides a current path for charging and discharging said capacitor with the rate of charge and discharge and thereby the period of the a.c. output being dependent on the resistance of said detection cell.

In the practical form earlier mentioned, in which the sensed parameter is frequency, the frequency discriminator comprises a timing standard including a resistance and a capacitance charged at a predetermined rate through the resistance. A diode clamp is provided responsive to the output of the a.c. source for discharging the timing capacitor during half cycles of the source of one polarity and for allowing charge to accumulate during half cycles of the other polarity. A threshold device is also provided responsive to the accumulated charge on the timing capacitor for actuating an alarm when the capacitor voltages exceed the threshold of said threshold device. An excessive voltage indicates that the period of the source has been prolonged beyond a normal value, indicating the presence of smoke. The discriminator threshold device is a Schmitt trigger using C-MOS FET.

In the second practical form of the invention, the electrical network includes an impedance comparable in value to the resistance of said detection cell at the frequency of the alternating voltage. The sensing means is an electrical comparator typically a half bridge device responsive to the relation of the cell resistance to the compared impedance for actuating an alarm when the relation falls below a prescribed value. It may measure either a voltage or current ratio, or the phase difference.

BRIEF DESCRIPTION OF THE DRAWING

The novel and distinctive features of the invention are set forth in the claims appended to the present application. The invention itself, however, together with further objects and advantages thereof may best be understood by reference to the following description and accompanying drawings, in which:

DESCRIPTION OF PREFERRED EMBODIMENTS

Figure 1:
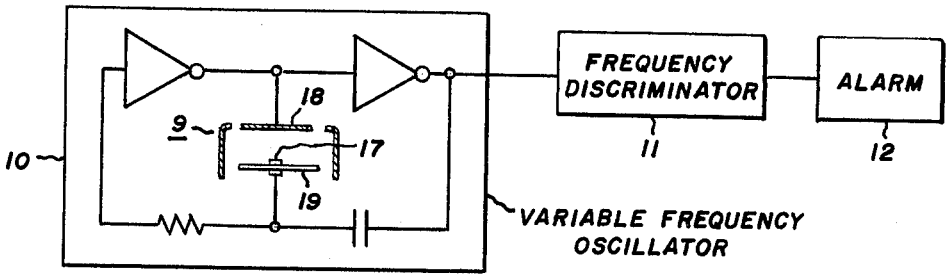
FIG. 1 is a block diagram of a novel smoke detector using an ionization type smoke detection cell connected into an electrical network. The network includes an oscillator whose frequency varies in response to any smoke induced changes in resistance in the smoke detection cell. The oscillator output frequency is sensed to indicate the presence of smoke.

FIG. 1 is a simplified block diagram showing the essentials of a novel smoke detector. The smoke detector is an electrical network into which an ionization type smoke detection cell is installed. When suitably electrically energized, the detection cell 9 exhibits a reduction in current or an increase in impedance in the presence of smoke. The electrical network comprises a variable frequency oscillator (10) whose frequency changes when the impedance of the detection cell changes in the presence of smoke; a frequency discriminator (11) which senses the oscillator frequency and produces a signal when a predetermined frequency change corresponding to a given smoke condition has occurred; and an alarm 12 which operates in response to the discriminator signal to give an alarm.

The smoke detection cell 9 is of known design and works upon the ionization principle. Suitable detection cells are described in the two copending patent applications of Robert J. Salem mentioned above. The particular detection cell includes a source 17 of $\alpha$ particle radiation, typically 1–3 microcurie source of Americium 241 installed in a measuring chamber. The chamber is defined by a pair of mutually insulated metallic members 18 and 19, which also establish an alternating electric field within the chamber in the region exposed to $\alpha$ particle radiation. The upper member 18 is a partial cylinder comprising a flat top and a cylindrical side wall. The top contains perforations around the perimeter to permit a free flow of air including any airborne products of combustion through it into the interior of the chamber. The opening at the bottom of the upper member is closed by the lower member 19. The lower member 19 is a circular disc, installed within the upper member to complete the generally closed cylindrical measuring chamber. The lower member 19 is of lesser diameter than the cylindrical side wall of the upper member 18, so as to provide electrical insulation and to leave a circular opening around the bottom of the chamber for facilitating air flow into the chamber. The two openings are designed to permit a free exchange of ambient air with that within the chamber. The chamber defined by members 18 and 19 is typically 4 centimeters in diameter and 0.75 centimeters in height. The Americium source 17 is on a 4 millimeter diameter wafer installed on a slightly elevated pedestal at the center of the lower member 19. Finally, each member 18 and 19 has a terminal designed to be connected to a source of voltage. When so connected the unperforated central portion of the upper member 18 and the lower member 19 form two parallel plates establishing a generally uniform electric field parallel to the axis of the cylinder in the air surrounding the Americium source.

The smoke detection process entails the active source of radiation, normally $\alpha$ particles; the presence of an electric field in the region around the source; and means to sense the electrical change which takes place in the detection cell when smoke or other products of combustion are present in the chamber. As noted, the observed electrical change is a change in current or in electrical impedance in the detection cell. The absolute current in the detection cell normally lies in the range of 10 – 500 picoamperes at voltages of less than 50 volts. The requirement for sensitivity in the electrical sensing network is accordingly very severe, and one in which static instability can readily cause a false indication. In accordance with the invention, static instability is avoided by a.c. operation of the detection cell and by the use of an a.c. sensing technique. The operating properties of the smoke detection cell will now be discussed with a view toward further specifying the requirements of the associated network.

Ordinary air is a quite good insulator, particularly at low fields. Assuming that a small electric field is established within a detection cell in which the radioactive source is absent, one encounters only very tiny currents, normally less than a picoampere ($10^{-12}$ amperes). While ordinary air is not a perfect insulator, a small number of ionized particles are frequently present, and these may be impelled under the influence of the field toward one or the other of the electrodes and support a small current. The current is small because the ionic motion is random and recombination neutralizes many ions before impingement on either electrode. At higher fields than of concern here, air will break down and support a high current discharge.

When a source of $\alpha$ particles is present, the detection cell becomes clearly conductive at low fields. The ionization smoke detector is operated at electrical fields in the linear region below the strength required to produce either saturation or electron multiplication.

Figure 2:
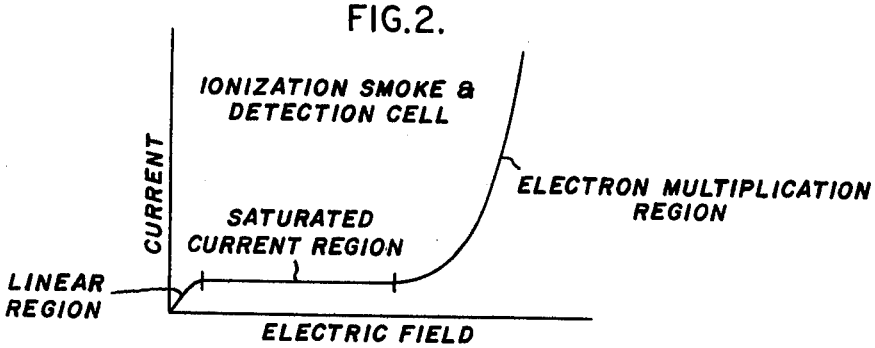
FIG. 2 is a graph illustrating the current of a representative ionization type, smoke detection cell under differing electric field conditions.

A graph of the conduction phenomenon of a representative detection cell is shown in FIG. 2. It exhibits three regions, distinguished by three ranges of electric field strengths. In the first or low field region, the current is small but detectable and increases approximately linearly with increasing field. This current arises from ions created by the $\alpha$ particles. The $\alpha$ particles emitted by the Americium source 17 are highly energetic (5.5 Mev), and assuming normal atmospheric pressures, each $\alpha$ particle will collide with large numbers of molecules in the surrounding gas to form ions. A single $\alpha$ particle at an average energy loss of 35 ev per collision has sufficient energy to create $10^5$ ions, and will lose much of its energy in this manner in the chamber. The usual inelastic collision strikes off a single electron leaving a positively charged singly ionized gas molecule. In air, the positively ionized molecule is usually nitrogen. The free electron has a short lifetime in air and quickly attaches itself to an oxygen molecule (usually) and creates a negatively charged gas molecule. All the ions exhibit average thermal velocities ($\sim 10^4$ cm/sec) which are much larger than the 1.8 cm/sec per volt/cm velocities imparted by low electrical fields. If the electrical field between the electrodes is small, the velocity imparted to a charged gas molecule in the direction of the collecting electrodes is small and the time available for recombination before impingement on an electrode is maximum, being set primarily by the thermal energy. As the electric field increases, the velocities imparted by the field in the direction of the electrodes become more significant in relation to the thermal velocities, gradually reducing the average time before an ion impinges on an electrode, and eventually causing a substantial reduction in the amount of time available for ionic recombination. In the low field region, ionic current increases approximately proportionally with the field.

The second and third conductive regions of FIG. 2 are called the saturation and electron multiplication region. These regions are avoided in operation of the detection cell. At higher fields, the ions are given a high velocity by the fields in the direction of the collecting electrodes. This means that most ions introduced into the chamber are collected in a very short time, and that the negative ions go to the positive electrodes, and the positive ions to the negative electrodes. Under these field conditions, ionic recombinations become negligibly small and substantially all ions are collected separately and contribute to the current flow. When this occurs, the current reaches a plateau region where further increases in field produce only slight increases in current. The lower boundary of the "saturation" region occurs at about 100 volts per cm. The upper boundary of the saturation region is set at the region where the field becomes strong enough to accelerate free electrons to a sufficient velocity to create additional ions in the air. Electron multiplication is the characteristic of the third conduction region.

When smoke is introduced into a chamber, assuming a suitable level of radiation and a suitable electrical field (below saturation and below electron multiplication), the ionization current is reduced. This is normally explained as due to smoke induced ionic recombination. When recombination occurs, an ion is neutralized before impact on the collecting electrode and any deposition of charge on the electrode is prevented. The particles of smoke are believed to provide sites for recombination of the gaseous ions and therefore the observed reduction in current in the presence of the smoke is attributed to this phenomenon.

The smoke induced recombination explanation depends upon the following assumptions and is generally assumed to be the correct one. The particles of smoke are massive in comparison to the gas molecules. Because of their size, they are slow moving under thermal effects. Their motion is essentially unaffected by the low electric field in the detection cell because of their size and low charge. When a gaseous ion strikes a smoke particle, a high probability exists for neutralization of the gaseous ion and a transfer of that charge to the smoke particle. A 1 micron smoke particle may be expected to be struck about $10^{16}$ times per second by a gas molecule. Assuming an equal chance for impact by positive or negative ions and a large number of impacts, the net charge on a given smoke particle may be expected to remain near zero.

The recombination effect can be substantial. In a chamber of a few cubic centimeters in volume, the total number of gas molecules may be $10^{20}$. Assuming a reasonable number of smoke particles, i.e., $10^4$ or more, one may expect most of the gas molecules to strike a smoke particle once per second, and most to lose their charge in the collison. In short, there will be enough ionic impacts with the smoke particles to neutralize a substantial percentage of ions and thus to substantially affect the conduction of the cell. In practice, most smoke detectors respond to from 1 to 4% smoke (i.e., smoke which reduces light transmission over a distance of a foot by 1 to 4%). The change in conduction at which the alarm is actuated is generally between 5% and 30%.

The ionization smoke detector is operated in the low field region, well below the saturation region. The preferred field lies between 5 and 15 volts, and with typical radioactive sources, the normal current level lies between 30 and 80 picoamperes. Lower electric fields than these show greater sensitivity to smoke, but also a greater likelihood of false triggering. The indicated choice represents a compromise between maximum sensitivity to smoke and a desired insensitivity to small changes in air velocity, and certain other effects which could produce false alarms.

Figure 3:
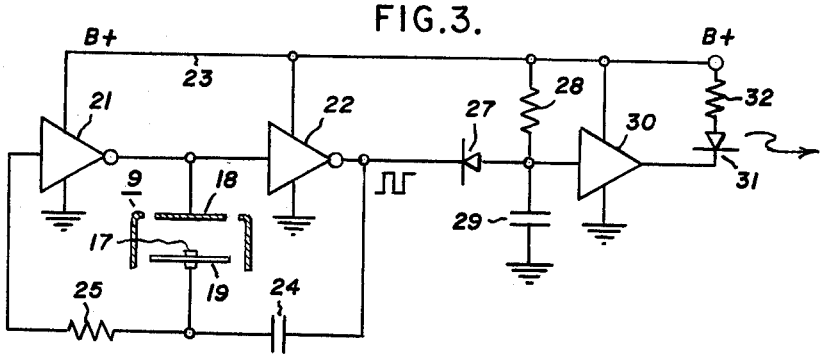
FIG. 3 is a more detailed diagram showing the principal functional components of the embodiment of FIG. 1.
Figure 4:
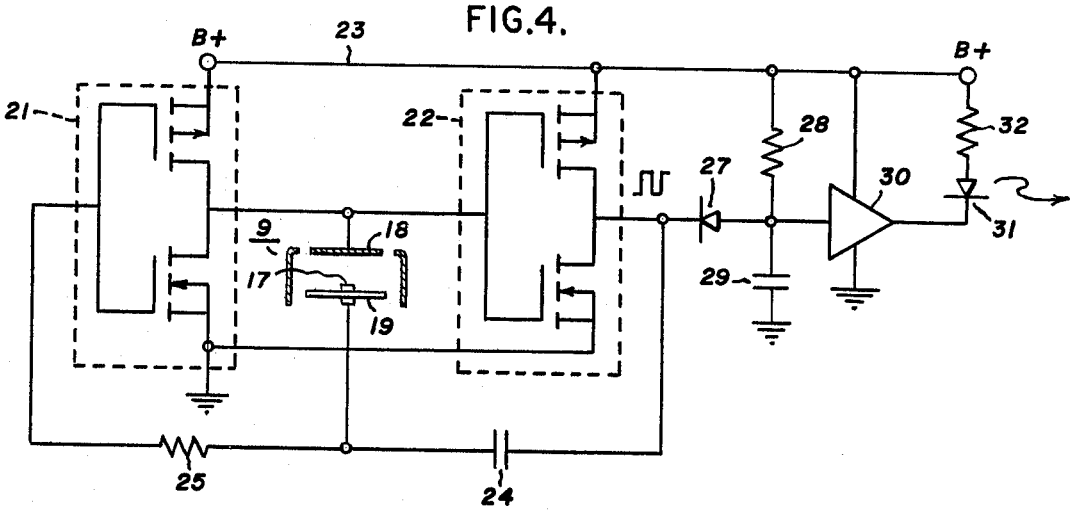
FIG. 4 is a third illustration of the embodiment of FIG. 1 showing the individual field effect transistors making up the oscillator portion of the electrical network.

Additional details of the FIG. 1 embodiment are shown in FIGS. 3 and 4. In this embodiment, the detection cell is electrically energized in an oscillator circuit whose frequency is affected by the state of conduction of the detection cell, and the oscillator frequency is then sensed to indicate the presence of smoke. As shown in FIG. 3, an oscillatory circuit is provided comprising a first (21) and a second (22) phase inverting amplifier. Both amplifiers 21 and 22 are coupled to a B+ bus 23 and to ground for d.c. energization. The first phase inverting amplifier 21 has its output d.c. coupled to the input of the second phase inverting amplifier 22. The output terminal of the second phase inverting amplifier 22 is fed back through a capacitor 24 connected in series with a resistance 25 to the input of the first amplifier 21. The foregoing feedback connection of elements 24 and 25 is regenerative since each amplifier 21, 22 produces a single phase inversion. The regenerative feedback latches the amplifier into one of two output states. The capacitor 24 and any resistance which would affect its charging or discharging rate sets the length of each output state and period of the oscillator.

The ionization chamber provides a resistance in the current paths to the capacitor that sets the oscillator period. The chamber 9 has one terminal 18 connected to the interconnection of the output of amplifier 21 to the input of the amplifier 22 and the other terminal 19 connected in the feedback path to the interconnection between capacitor 24 and resistance 25. By this connection, the ionization chamber alternately provides a high resistance current path to the B+ bus to charge the capacitor toward the B+ potential and a high resistance current path to ground to discharge the capacitor 24 to ground potential. Since the capacitor 24 is coupled to the input gate of amplifier 21, its voltage (in consequence of its state of charge) upon crossing a voltage in the vicinity of B+/2, immediately reverses the states of both amplifiers and steps the oscillator to the alternate output state. Since the oscillation period is the sum of the times of the two output states and is governed by the charging and discharging process, it is set by the RC time constant, made up of the resistance of the ionization detection cell and the capacitance of capacitor 24.

Since the oscillator frequency is set by the instantaneous resistance of the ionization chamber and the capacitance of the capacitor 24, any smoke induced changes in chamber resistance will cause a corresponding change in oscillator frequency. The normal parameters establish a low frequency in the region of 1 hertz. When smoke is present, the chamber resistance is increased. This increases the time constant of the RC network and decreases the oscillation frequency.

The installation of the ionization chamber into the oscillator circuit also provides it with the requisite voltage for sensitive operation. As may be shown by waveforms similar to those in FIG. 6, once the oscillator begins to oscillate, a low a.c. potential is applied across the ionization chamber. The chamber terminal 18 alternates between near ground and B+ potential, and the chamber terminal 19 connected to the input gate of 21 varies about a voltage half way between B+ and ground. Thus, the voltage applied to the chamber is half the B+ voltage and of alternating polarity. The B+ voltage and chamber dimensions are set so that the ionization chamber is operated in the desired field region.

The reduction in oscillator frequency is sensed and the smoke detection is achieved by the remaining portions of the network of FIG. 3 comprising the elements 27, 28, 29, 30, 31 and 32. Elements 27, 28, 29 and 30 of FIG. 3 correspond to the frequency discriminator 11 of FIG. 1 and elements 31 and 32 correspond to the alarm 12 of FIG. 1. The output of amplifier 22 containing oscillations is coupled to the cathode of diode 27 whose anode is connected to the first terminal of capacitor 29. The same capacitor terminal is coupled to the input of a threshold amplifier 30 and through resistance 28 to the B+ bus 23. The other terminal of capacitor 29 is grounded. The threshold amplifier 30, which may be a Schmitt trigger, is energized by connection to the B+ bus 23 and to ground. The output of threshold amplifier 30 is coupled to a light emitting diode 31 coupled through resistance 32 to the B+ bus 23.

The frequency discriminator and alarm portions of the electrical network function in the following manner to sense a reduction in oscillator frequency and to indicate the presence of smoke. The capacitor 29 is recurrently charged toward the B+ potential through resistance 28 at a rate dependent on the values of the resistance 28 and the capacitor 29, and it is recurrently discharged through diode 27 once in each oscillator cycle. Assuming that the output of the oscillation network is momentarily at a zero potential, the diode 27 is forwardly biased and discharges capacitor 29. When the oscillator output switches to a positive value, current flow through the diode 27 is blocked and capacitor 29 is permitted to begin to charge through resistance 28 toward the B+ voltage. The charging of the capacitor 29 continues through the positive half cycle of the oscillator output until the oscillator output switches to zero. If the voltage on the capacitor increases beyond the threshold of the amplifier 30 during this half cycle, then the amplifier 30 is turned on, energizing the light emitting diode, and activating a suitable alarm circuit, not specifically shown. The charging rate is thus set by the circuit constants $R_{28}$, $C_{29}$ while the period allocated for the charge to accumulate is set by the duration of the oscillator period and the threshold of amplifier 30.

In performing the frequency discrimination function, the oscillator period is prolonged past the standard period. If the oscillator section is operating at the normal period (or faster), the onset of a negative oscillator half period turns on the clamping diode 27 and discharges the capacitor 29 before the stored voltage has exceeded the threshold of amplifier 30. In the event that the oscillator period is increased, as by the presence of smoke in the detection chamber, the onset of the next negative oscillator half period is delayed and the resistor 28 is allowed to charge the capacitor 29 to a value exceeding the threshold of amplifier 30. When the threshold is exceeded, the alarm is operated. In one practical case, with a normal oscillator period of about 1 second (i.e., a frequency of 1 hertz), the presence of 4% smoke has been observed to increase the period to 1.6 seconds (i.e., a frequency of 0.63 hertz) corresponding to a 60% increase in the period (i.e., 37% reduction in frequency).

FIG. 4 illustrates the oscillator circuitry of the FIG. 1 embodiment using conventional C-MOS field effect transistors. They provide the d.c. isolation to the ionization detection cell necessary to sensitive operation. Each of the amplifiers 21 and 22 is seen to consist of a push-pull connected P MOS FET and N MOS FET with the bias current flowing through the FET devices in series between B+ and ground. The output terminal of the amplifier 21 is the interconnection of the source of the P MOS FET with the drain of the N MOS FET, at which point the push-pull output appears. The terminal 18 of the ionization chamber 26 is connected to the push-pull output of amplifier 21 and also to the input gate of the second amplifier 22. Connection to the output of 21 provides a low impedance connection to terminal 18 of the chamber. The P MOS FET, when it is conductive, connects the amplifier output terminal to B+ and the N MOS FET, when it is conductive, connects the amplifier output terminal to ground. Since the devices in amplifier 21 conduct alternatively, one or the other low impedance connection is always present at terminal 18.

Terminal 19 of the ionization chamber, also coupled to capacitor 24, is provided with maximum d.c. isolation. Terminal 19 is led through a 1 megohm resistance to the input gates of the input amplifier. The resistance 25 is small in terms of other parameters and is designed to prevent damage to the amplifier input devices. The input gates of the input amplifier are of high impedance at all times, and thus provide negligible leakage to terminal 19 of the ionization chamber. With conventional FETs, this gate impedance is substantially higher than the operating impedance of the ionization chamber and has no adverse effect on sensitivity. The indicated polarity of connection of the chamber into the circuit which puts the outer shell on the low impedance connection avoids the need for shielding the case of the ionization chamber.

The size of the capacitor 24 is set by the desired operating frequency and certain other considerations. The frequency of the oscillation of the first embodiment is determined by the RC time constant comprising the resistance of the ionization chamber and the size of the integrating capacitor 24 and any paralleled capacity. Its a.c. impedance at the operating frequency is thus made substantially lower than the resistive impedance of the detection cell, and it may be regarded as operating as an integrator of the current exchanged with the detection chamber.

In addition, the capacitor must be of low leakage design. The minimum capacitor size is set by the stray capacitance associated with the circuit wiring and the associated capacitance of the comparator network. It is typically about 20 picofarads. The maximum size is limited by the magnitude of current available from the ion chamber and the minimum interval desired between possible alarm outputs.

$\Delta V$ = threshold voltage
I = ion chamber current
C = capacitance
$\Delta t$ = alarm test interval $$I = c\frac{\Delta V}{\Delta t}$$

$$C = \frac{I\Delta t}{\Delta V} \quad \frac{60 \times 10^{-12} \times 1 \text{ sec}}{3V}$$

$C \approx 20$ pf

Figure 5:
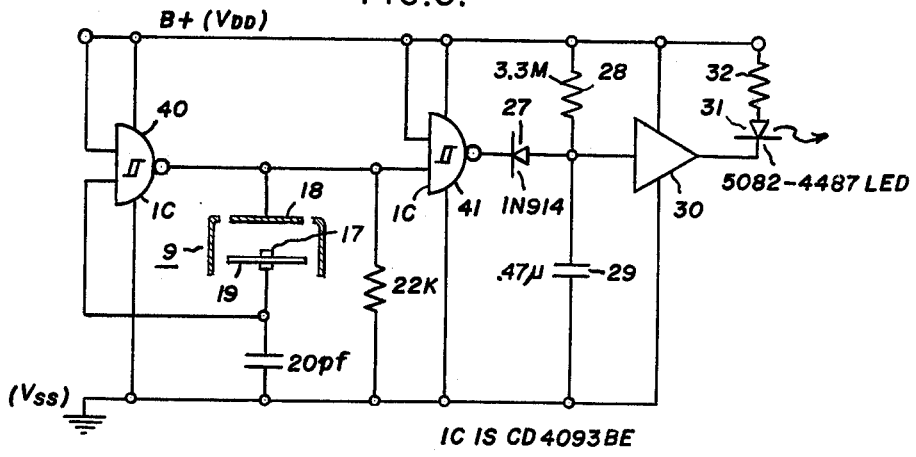
FIG. 5 is a simplified block diagram of a second embodiment of the invention in which a Schmitt trigger using FET devices is employed in the oscillator portion of the associated electrical network.
Figure 6A:
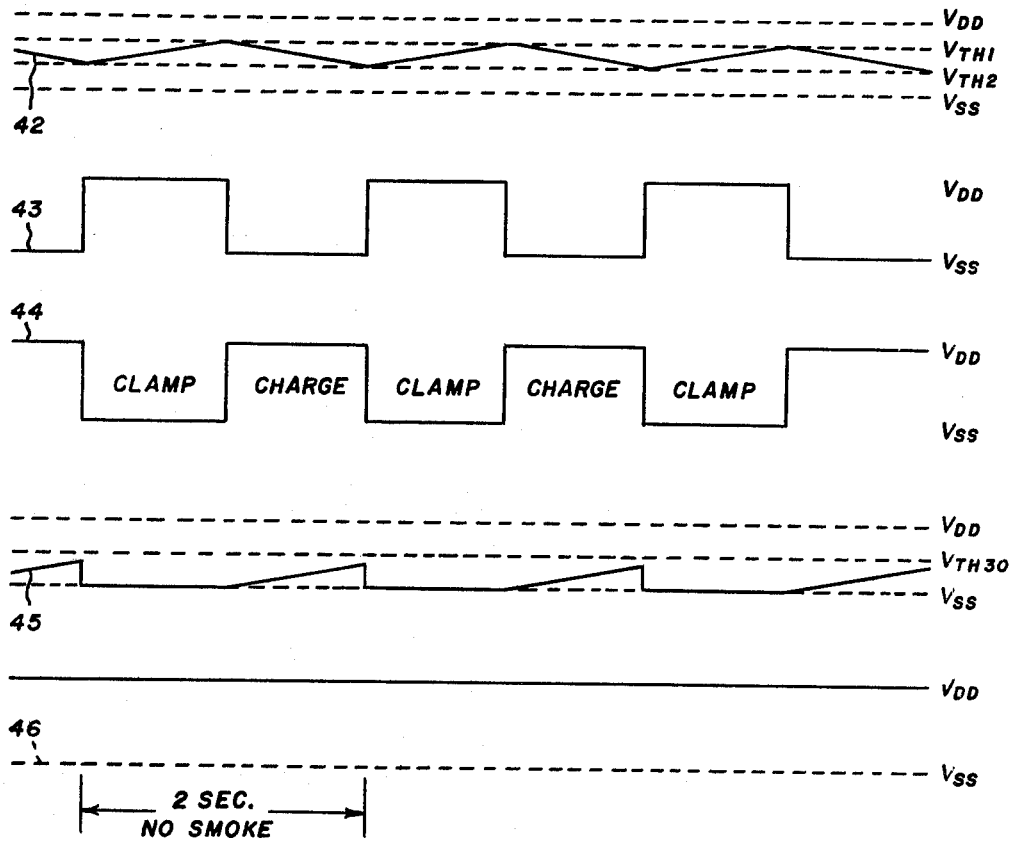
FIG. 6A is a collection of waveforms illustrating the operation of the second embodiment during no smoke.
Figure 6B:
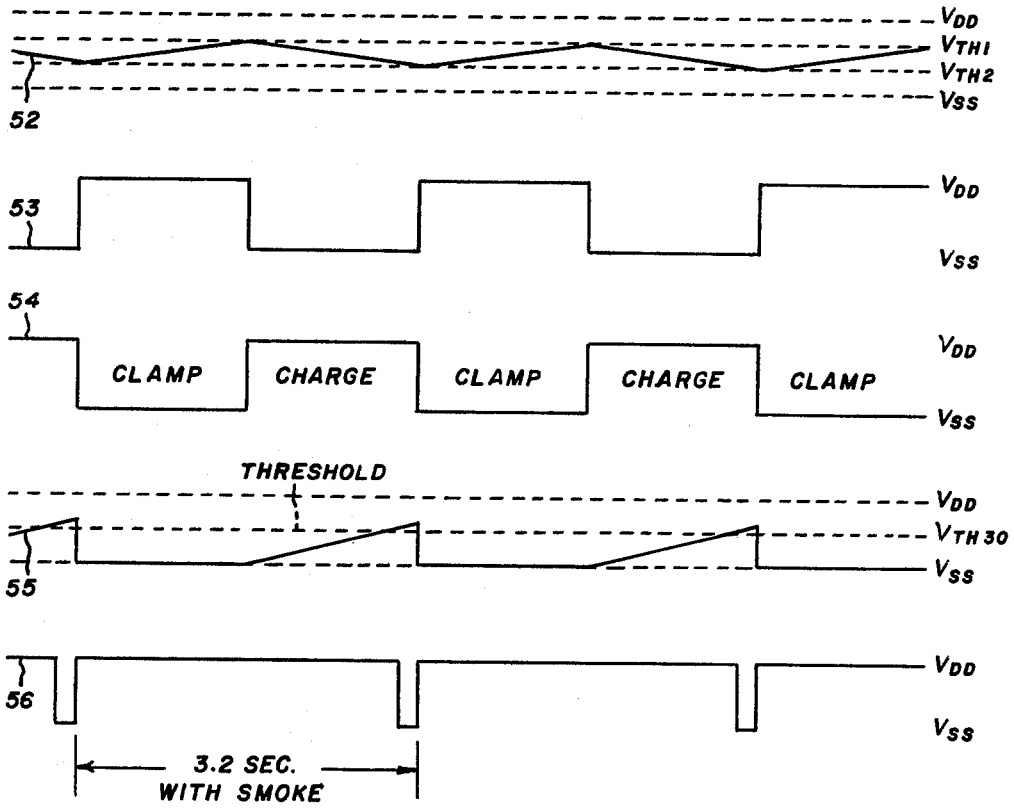
FIG. 6B is a corresponding collection when smoke is present.

A second and preferred embodiment of the invention is shown in FIG. 5, with the operating waveforms shown in FIG. 6. In this embodiment, the phase inverting amplifiers 21 and 22 are replaced by a Schmitt trigger 40 of FET design. A second Schmitt trigger 41 is used as a buffer between the oscillator and frequency detector and is not essential to circuit operation. The discriminator and alarm portions of the network are as in the first embodiment. The voltage at the input of trigger 40 is shown at 42. The input voltage rises linearly until it crosses an upper threshold ($V_{TH1}$) and then falls linearly while it crosses a lower threshold ($V_{TH2}$). These thresholds are equally spaced above and below an average value approximately midway between the source ($V_{ss}$) and drain ($V_{dd}$) voltage. The output of the first Schmidt trigger 40 is shown at 43. It is a square wave alternating between source ($V_{ss}$) and drain ($V_{dd}$) voltages (i.e., B+ and ground). The output of the second Schmidt trigger 41 is shown at 44. It is like the output of 40 except for being of opposite phase. The output of 41 is used to periodically clamp the capacitor charging circuit 28, 29 through diode 27. Under no smoke conditions, output waveform 44 has a half period of about 1 second. Waveform 45 represents the voltage on capacitor 29, which is connected to the input of the threshold amplifier 30. Waveform 45 is also shown under no smoke conditions. The capacitor waveform consists of a $V_{ss}$ portion, i.e., zero volts, which is maintained when the output waveform is at $V_{ss}$. When the output waveform switches to $V_{dd}$, the capacitor waveform possesses a positive slope which increases toward the threshold voltage of amplifier 30 ($V_{TH30}$). In the remainder of the $V_{dd}$ half cycle of the output waveform, the capacitor waveform increases linearly, and then is clamped back to $V_{ss}$, i.e., ground potential, when the next half cycle of the output waveform begins. When no smoke is present, the charging period of capacitor 29 is too short to allow its voltage to exceed the threshold of the threshold amplifier 30. Waveform 46 is the output waveform of threshold amplifier 30. Under no smoke conditions, the waveform 46 remains at $V_{dd}$ without change and generates no alarm.

Curves 52, 53, 54, 55 and 56 illustrate the waveforms in the second embodiment when smoke is present and detected. Under smoke conditions, the waveforms 52, 53 and 54, (corresponding to the prior waveforms 42, 43 and 44) are of longer duration, illustrating the lengthening of the oscillation period when smoke is present. In the illustration, the oscillation half period is about 1.6 seconds. Waveform 55 illustrates the voltage at the capacitor 29, which charges at the same rate as before. Under smoke conditions, there is now a longer time for capacitor 29 to accumulate a charge. Accordingly, the capacitor 29 now charges to a voltage exceeding the threshold of amplifier 30 ($V_{TH30}$). When the capacitor voltage 23 exceeds the threshold of amplifier 30, the amplifier produces an output pulse as shown at 56. The pulse portions of waveform 56 continues until the end of the charge cycle of waveform 55, and is repeated once each oscillation. The output pulse energizes the warning circuit, including the light emitting diode 31.

Figure 7:
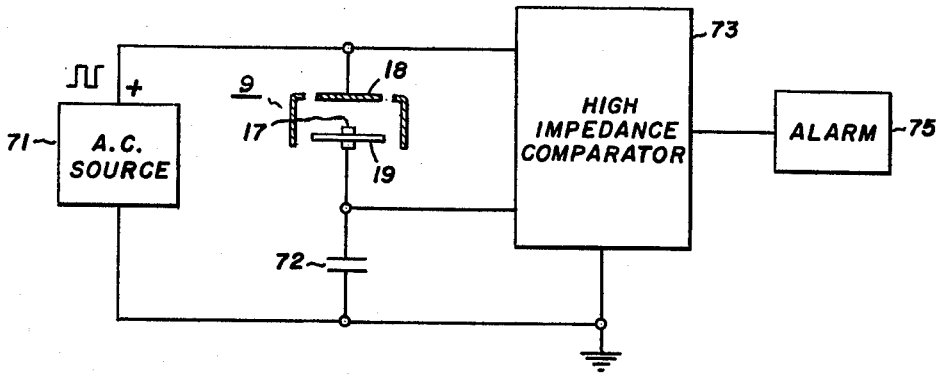
FIG. 7 is a simplified block diagram of a third embodiment in which the impedance of the smoke detection cell is compared to a reference impedance using an applied a.c. wave. The impedance of the smoke detection cell, which changes in the presence of smoke, produces a corresponding change in the impedance ratio, which is sensed to indicate smoke.

In both embodiments 1 and 2 the smoke detection cell is installed in an oscillation circuit, in which the detection cell is energized, and its conductance is changed in the presence of smoke and changes the oscillator frequency. The change in oscillator frequency is then sensed to detect the presence of smoke. In FIG. 7, a third embodiment of the invention is disclosed in which the detection cell is energized by an a.c. waveform from a source 71 of fixed frequency. In this embodiment, the detection cell is connected in circuit with a second impedance 72 to provide an a.c. "half" bridge. For greater precision, a "full" bridge may be used. The a.c. impedance of 72 should be comparable to the impedance of the smoke detection cell and may take the form of a large valued resistance or a small capacitor. One advantage of operating at low frequency a.c. is that low cost capacitors can be used to provide an accurate and stable second impedance. The impedance of the smoke detection cell is then compared in an a.c. comparator 73 with the second impedance 72. The comparator may make either a voltage or current amplitude or a phase comparison. The comparator should be of high input impedance at the central arm of the bridge to function properly. The impedance should be on the order of $10^{12}$ ohms to avoid insensitivity, and is readily achieved using conventional FET devices, which have characteristically high impedances. A major advantage of a.c. operation of the smoke detector is that it avoids many of the problems due to static charge build up or drift intrinsic to d.c. circuits of this high impedance. The comparator output is then thresholded to produce an alarm when the impedance of the detection chamber increases above a desired ratio to the standard in a circuit which may be similar to that used in the prior embodiments.

What is new and desired to be secured by Letters Patent of the United States is:

1. A smoke detector comprising:

A. a smoke detection cell including:

(1) a measuring chamber open to the ambient air and any airborne products of combustion, (2) a source of radiation disposed within said chamber for ionizing the contained air and airborne matter, (3) a pair of spaced conductive electrodes disposed within said chamber for establishing an electric field which attracts positively ionized particles to one electrode and negatively ionized particles to the other electrode, ionic impingement on said electrodes producing a small current whose direction depends on field polarity, the detection cell current decreasing and its resistance increasing when airborne combustion products are present in the air, and B. an electrical network into which said detection cell is connected, comprising:

(1) an alternating voltage source, (2) means for applying said alternating voltage to said detection cell to provide a bidirectional current flow therein, and (3) sensing means responsive to a network parameter dependent on the resistance of said detection cell for actuating an alarm when a predetermined increase in resistance of said detection cell has taken place indicating the presence of airborne combustion products.

2. A smoke detector as in claim 1 wherein the frequency of said source of alternating voltage varies as a function of the resistance of said detection cell, and wherein said sensing means is a frequency discriminator.

3. The combination set forth in claim 2 wherein said a.c. source produces a square wave output and includes a first and a second phase inverting amplifier connected in cascade and having a regenerative feedback path comprising a capacitor coupled between the output of said second amplifier and the input of said first amplifier, and wherein a first detection cell electrode is coupled to the input of said first inverting amplifier, and the second detection cell electrode is coupled to the output of said first inverting amplifier, said detection cell providing a current path for charging and discharging said capacitor, the rate of charge and discharge and thereby the period of said a.c. output being dependent on the resistance of said detection cell.

4. The combination set forth in claim 3 wherein said first and second inverting amplifier each have a single threshold and produce a square wave output of variable frequency.

5. The combination set forth in claim 4 wherein said first and second inverting amplifiers are C-MOS FET devices, each amplifier comprising a P channel and an N channel FET, connected in push-pull to provide an inverting amplifier.

6. The combination set forth in claim 2 wherein said a.c. source produces a square wave output and includes a double threshold amplifier having an output exhibiting hysteresis in respect to the input and having a regenerative feedback path comprising said detection cell coupled between the amplifier output and amplifier input and a capacitor coupled between the amplifier input and ground, said detection cell providing a current path for charging and discharging said capacitor, the rate of charge and discharge and thereby the period of said a.c. output being dependent on the resistance of said detection cell.

7. The combination set forth in claim 6 wherein said frequency discriminator comprises:

(a) a timing standard including a resistance and a capacitance charged at a predetermined rate through said resistance, (b) a diode clamp responsive to the output of said a.c. source for discharging said timing capacitor during half cycles of said source of one polarity, and for allowing charge to accumulate during half cycles of the other polarity, and (c) a timing threshold device responsive to the accumulated charge on said timing capacitor for actuating an alarm when the capacitor voltages exceed the threshold of said threshold device, said excessive voltage indicating the period of said source has been prolonged beyond a normal value, indicating the presence of smoke.

8. The combination set forth in claim 7 wherein said timing threshold devices is an FET.

9. The combination set forth in claim 8 wherein said timing threshold device is a Schmitt trigger using C-MOS FETs.

10. A smoke detector as in claim 1 wherein said electrical network includes:

(1) an impedance comparable in value to the resistance of said detection cell at the frequency of said alternating voltage, and wherein (2) said sensing means is an electrical comparator responsive to the relation of said cell resistance to said compared impedance for actuating an alarm when said relation falls below a prescribed value.

11. A smoke detector as set forth in claim 10 wherein said impedance is a capacitor.

* * * * *